US008721400B2

(12) United States Patent
Ouellette

(10) Patent No.: US 8,721,400 B2
(45) Date of Patent: May 13, 2014

(54) SANDING AND GRINDING TOOL HAVING DEPTH GUIDE

(76) Inventor: James-Roy Ouellette, Oshawa (CA)

( * ) Notice: Subject to any disclaimer, the term of this patent is extended or adjusted under 35 U.S.C. 154(b) by 516 days.

(21) Appl. No.: 13/064,393

(22) Filed: Mar. 23, 2011

(65) Prior Publication Data

US 2011/0237167 A1 Sep. 29, 2011

Related U.S. Application Data

(60) Provisional application No. 61/282,731, filed on Mar. 24, 2010.

(51) Int. Cl.
*B24B 23/02* (2006.01)

(52) U.S. Cl.
USPC ..... 451/358; 451/352

(58) Field of Classification Search
USPC ..... 451/344, 352, 358; 125/13.01, 13.03; 299/39.4, 39.6
See application file for complete search history.

(56) References Cited

U.S. PATENT DOCUMENTS

| | | | | |
|---|---|---|---|---|
| 3,779,607 | A * | 12/1973 | Staab | 299/39.4 |
| 4,188,934 | A * | 2/1980 | Reinhardt et al. | 125/4 |
| 4,523,361 | A * | 6/1985 | Dummermuth | 29/81.05 |
| 4,993,192 | A * | 2/1991 | Demetrius | 451/358 |
| 5,176,478 | A | 1/1993 | Munch | |
| 6,484,711 | B2 * | 11/2002 | Acker et al. | 125/13.01 |
| 7,000,605 | B2 * | 2/2006 | Due | 125/13.01 |
| 7,029,370 | B2 * | 4/2006 | Cochran et al. | 451/11 |
| 7,300,339 | B2 * | 11/2007 | Gaul et al. | 451/451 |
| 7,469,694 | B2 * | 12/2008 | Howard et al. | 125/13.01 |
| 2008/0045128 | A1 * | 2/2008 | Trueit et al. | 451/358 |
| 2008/0153402 | A1 * | 6/2008 | Arcona et al. | 451/352 |

* cited by examiner

*Primary Examiner* — Eileen P. Morgan

(57) ABSTRACT

A sanding or grinding tool has a drum provided with an abrasive cylindrical outer wall. The depth guide has a curved outer surface composed of a number of arcuate segments each having a radius which extends outward from the centre of the guide and which is of a differing defined length. The depth guide is rotatable in increments to cause each segment, in turn, to face the work piece. Each facing segment functions to define the depth of material removed from the surface of the work piece.

14 Claims, 7 Drawing Sheets

SANDING AND GRINDING TOOL HAVING DEPTH GUIDE

This application claims priority pursuant to 35 U.S.C. 119(e) of U.S. provisional application 61/282,731, filed Mar. 24, 2010, the entire contents of which are herein incorporated by reference.

FIELD OF THE INVENTION

This invention relates to sanders and grinders and more particularly to a tool for sanding or grinding a work piece and having means for adjusting the depth of material removed from the surface of the work piece.

BACKGROUND OF THE INVENTION

Conventional sanders have plates or discs to which sandpaper is attached. Some of those plates and discs are inflexible while others are flexible but the common feature of most plates and discs is that they are flat. Being flat, they are suited to smoothing flat surfaces but are not well suited to smoothing curved surfaces such as those which are concave and convex. Such surfaces are commonly found in the hulls of relatively small boats such as motor boats, canoes and row boats. A conventional sander used to smooth such surfaces frequently produces undesirable nicks and gouges in them. Moreover, such sanders rarely have effective control over how much material is removed so that the sanded surface has in addition to nicks and gouges, many uneven areas.

I have invented a tool which substantially overcomes the disadvantages of conventional sanders mentioned above. The tool has a round plate in the form of a drum to which sandpaper is attached and has means for adjusting the depth of material removed from a surface. My tool is accordingly well suited to smoothing curved surfaces such as the hulls of boats, the exterior surfaces of cars and so on. Not only is my tool suited for use as a sander but it is also suited for use as a grinder for smoothing, for example, the surfaces of components of machinery.

SUMMARY OF THE INVENTION

Briefly the tool of my invention includes: a housing; a drum rotatable relative to the housing and having an abrasive cylindrical outer wall; and a depth guide for limiting the depth of penetration of the outer wall into the surface of a piece of work.

DESCRIPTION OF THE DRAWINGS

The tool of my invention is described with reference to the accompanying drawings in which.

DESCRIPTION OF PREFERRED EMBODIMENT

Figure 1:
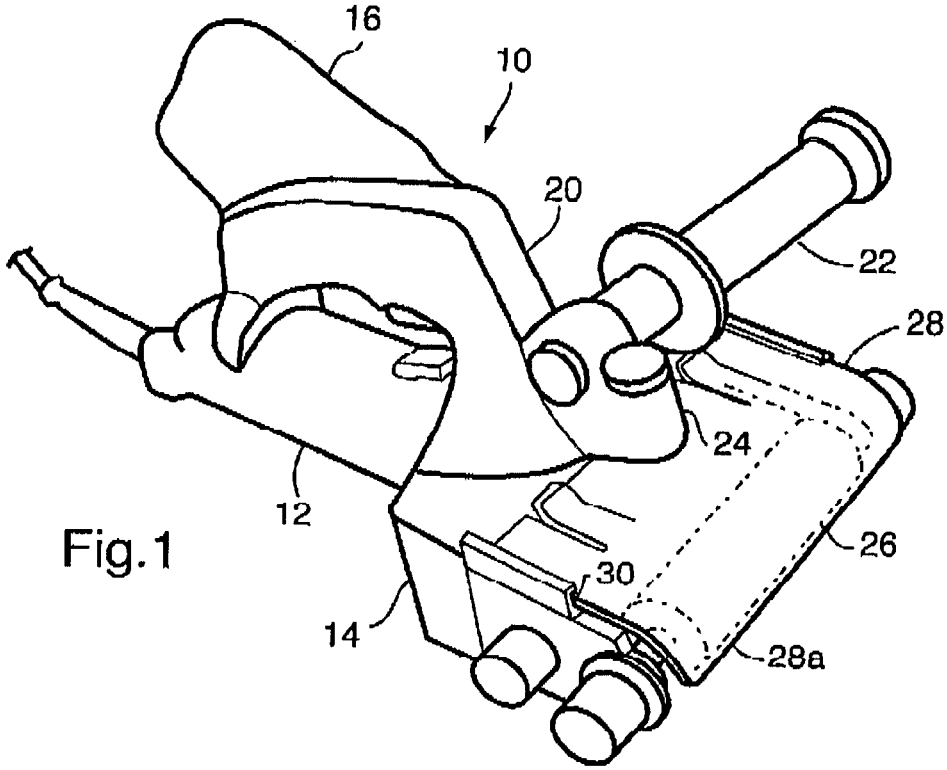
FIG. 1 is a perspective view of the tool.

With reference to FIGS. 1-5, the sanding and grinding tool of the invention, generally 10, is composed of a conventional electric motor 12 and a housing 14. A bag 16 for dust and debris generated during the sanding and grinding operations is attached to a nozzle 18 which opens into the interior of the housing.

Figure 2:
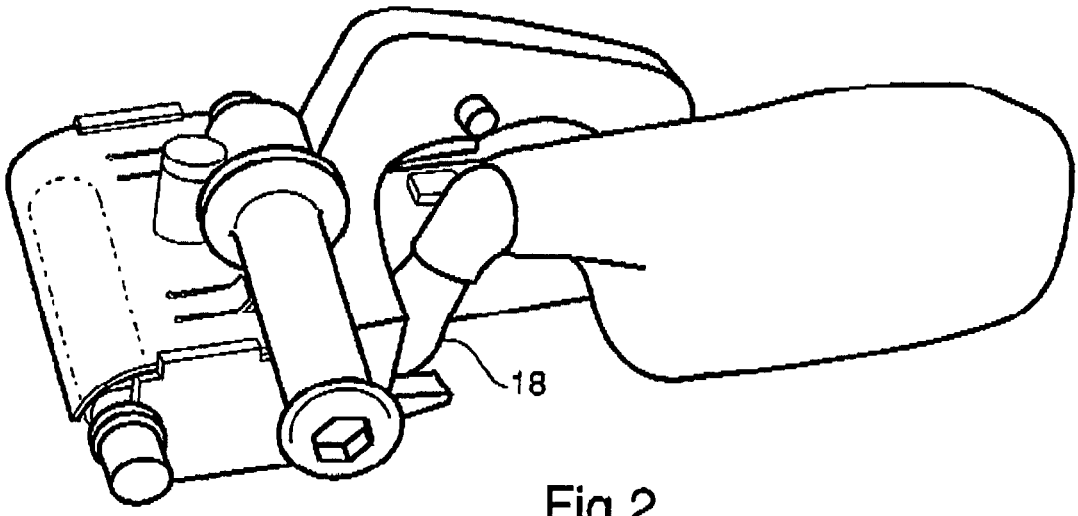
FIG. 2 is another perspective view of the tool from the side opposite that illustrated in FIG. 1.
Figure 4:
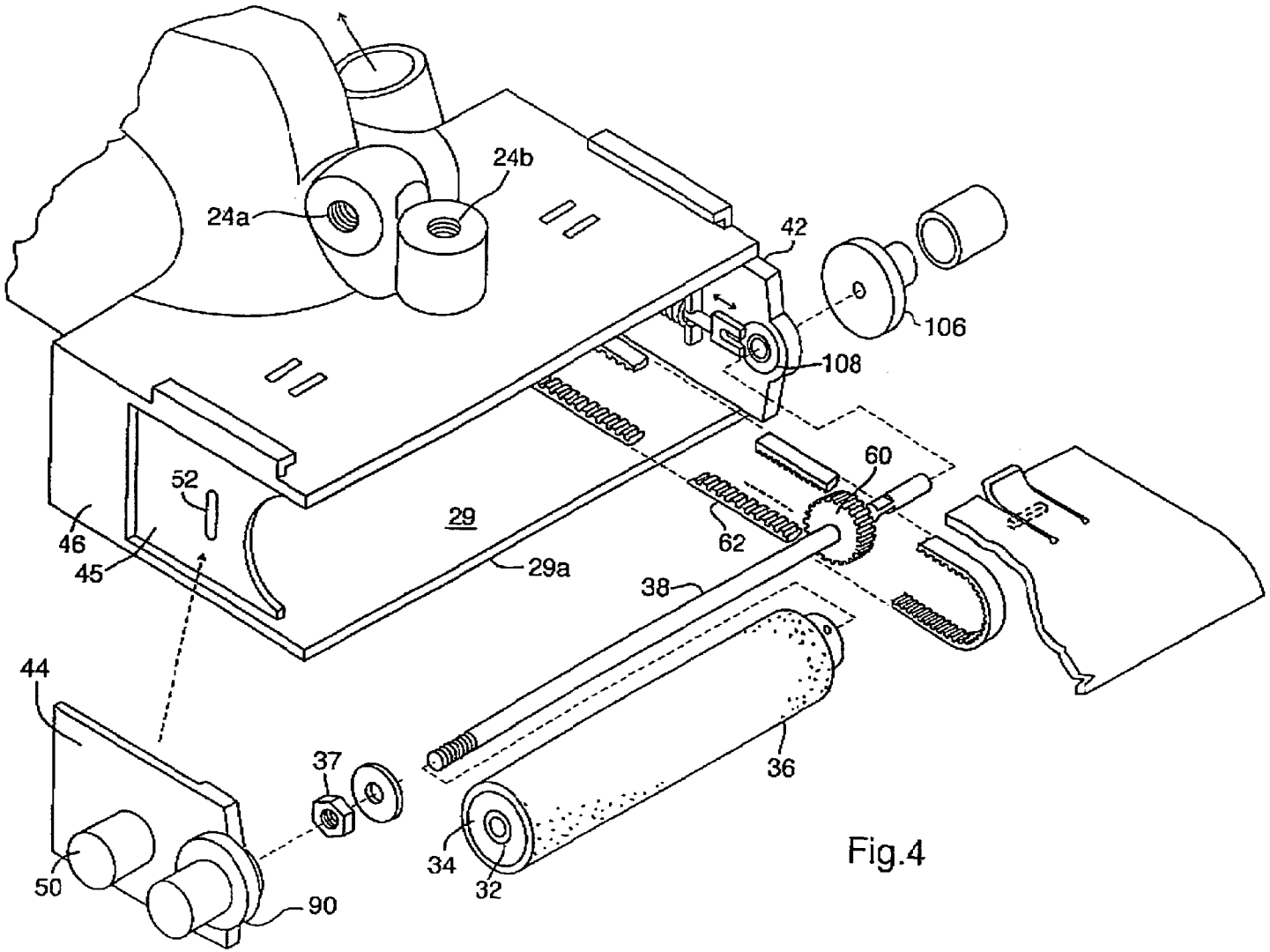
FIG. 4 is an exploded perspective view of the tool.

The tool has two handles, a vertical hand grip 20 which extends upwardly from the housing and a horizontal cylindrical handle 22 which is threadably connected to a joint 24. The joint is permanently mounted to the top wall of the housing. Handle 22 can be connected to any one of three threaded openings in the joint, one of which opens to the left as illustrated in FIGS. 1 and 2, a second 24*a* to the right as illustrated in FIG. 4 and a third 24*b* upwardly also illustrated in FIG. 4. Handle 22 can accordingly be selectively attached so that it extends vertically and so that it extends horizontally and in the latter case the handle can selectively extend to the right and to the left from the joint.

Rotatably mounted within the housing at its forward end is a drum 26. Above the drum is a guard 28 having a forward overhanging edge 28*a* which curls over the top of the drum. The guard defines the upper wall of the housing. Below the drum is a lower wall 29 of the housing having a bevelled front edge 29*a* which acts as a dust scoop.

Guard 28 serves a number of purposes: it prevents an operator of the tool from accidentally touching the drum; it directs dust generated during the sanding or grinding operation into the interior of the housing where it flows through nozzle 18 and exits to dust bag 16; and it prevents particles dislodged from a work piece from flying over the top of the drum where it can cause injury to the operator of the tool or damage to the work piece.

Figure 3:
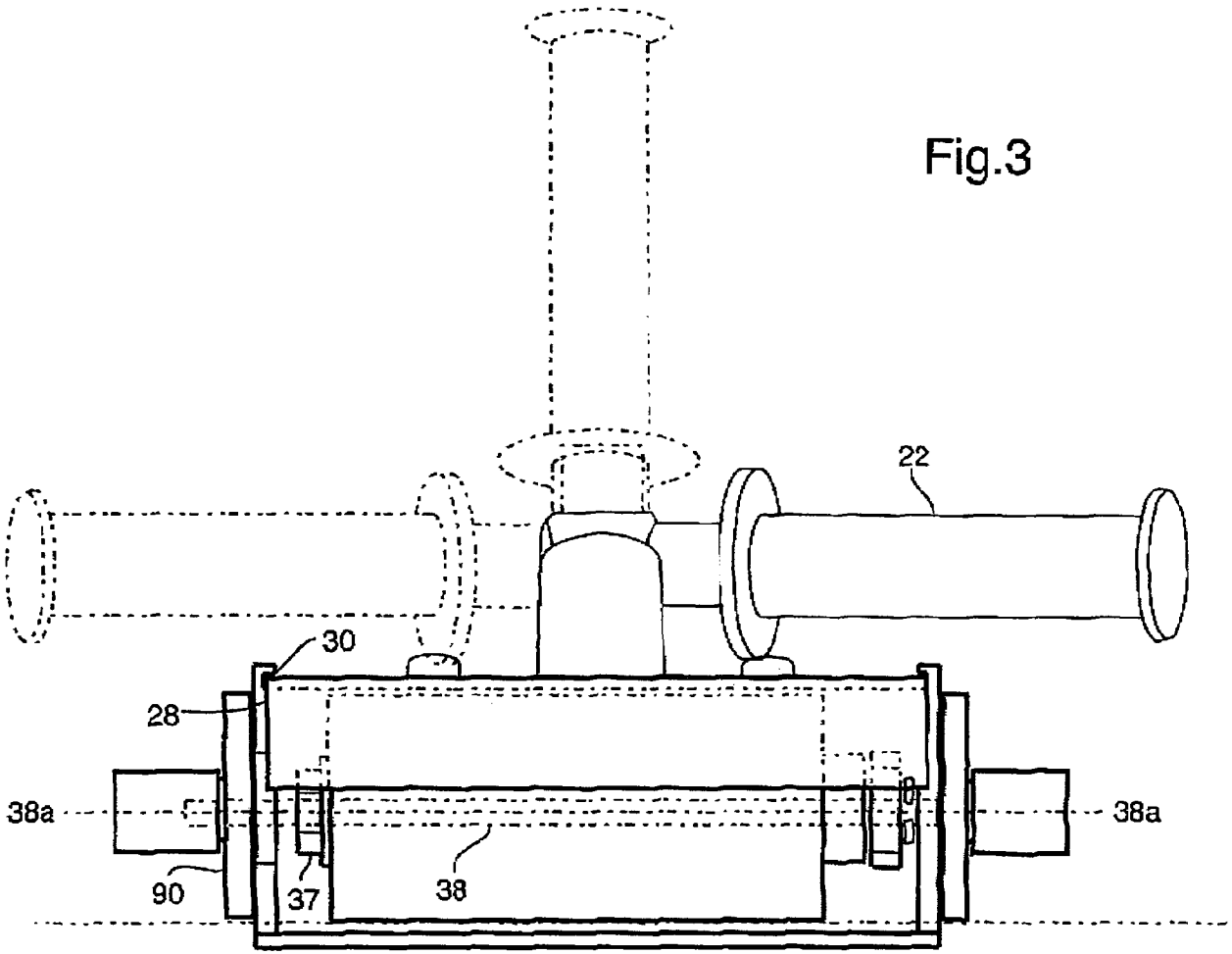
FIG. 3 is a plan view of the forward end of the tool.

As illustrated in FIG. 3, the guard is slidably mounted in grooves 30 which extend upwardly from opposite side walls of the housing. When the tool is not operating, the guard can be slid forward in order to gain access to the interior of the housing.

Figure 8:
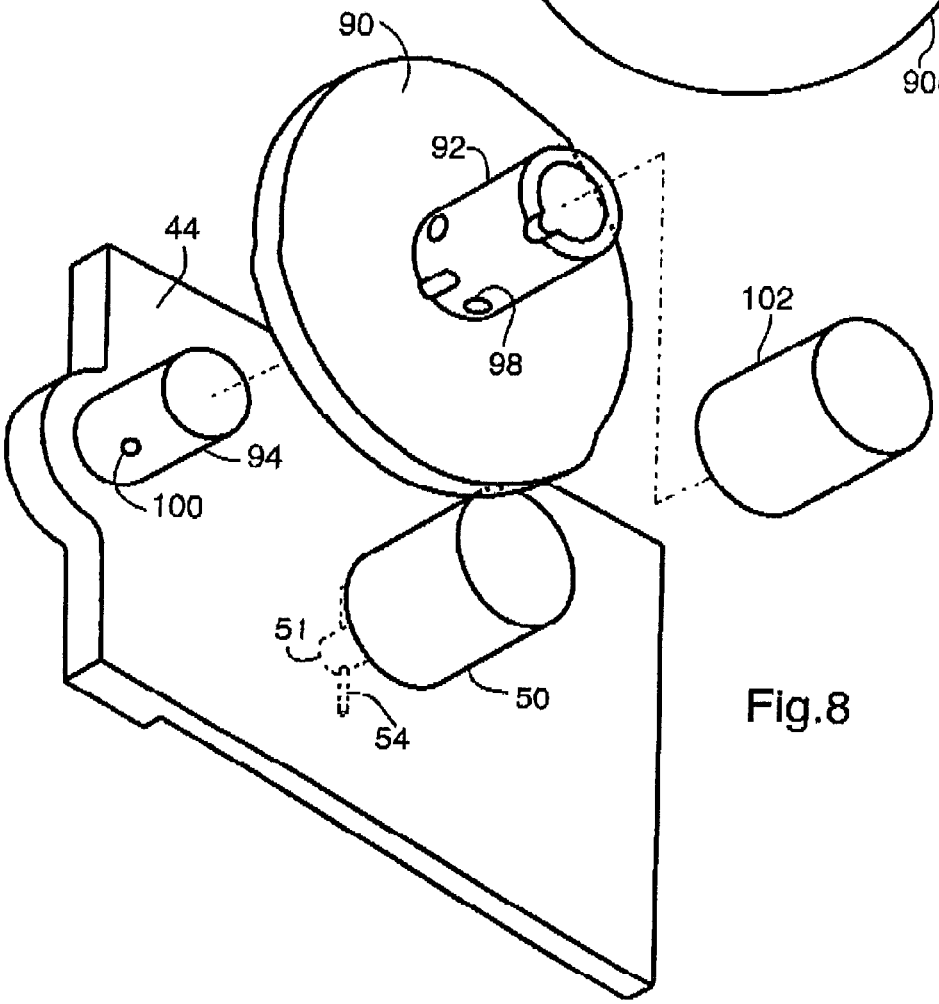
FIG. 8 is an exploded perspective view of the depth guide and a portion of the tool to which the depth guide is attached.

With reference to FIGS. 3, 4 and 8 drum 26 has an inner bushing 32 and an outer sleeve 34 the latter preferably composed of flexible rubber and the former preferably composed of less flexible material and functioning to stop the outer sleeve from binding on roller shaft 38 during placement and positioning. A sanding sleeve 36 surrounds the outer sleeve. The sleeves are secured to the shaft by hexagonal nuts 37 and washers as is conventional.

Roller shaft 38 is mounted for rotation in bearings in left side wall 42 and in a removable side panel 44. The side panel has bevelled edges so that it is self aligning when received in a conforming recess 45, also with bevelled edges, in right side wall 46 and is removably held in the recess by means of a pin. The pin has a head 50 and a spring loaded shaft 51 which extends through an opening in the plate and through a second opening 52 in the right side wall. The pin is held in place by means of a roller pin 54, a hexagonal nut or other securing means until removed when the side panel can be removed from the recess. Once removed, the roller shaft can be withdrawn from bearings in the inside wall of the removable side panel.

When the roller shaft is withdrawn, drum 26 can be removed from the roller shaft and be replaced by a drum of larger or smaller diameter or one having a different abrasive. For example, the drum which might be suitable for sanding but not grinding. Where the tool is used for grinding, the drum could be replaced by another drum having an outer wall which is suitable for such.

A gear wheel 60 is fixed to the roller shaft and is driven by a toothed belt 62 which in turn is driven by motor 12.

Figure 5:
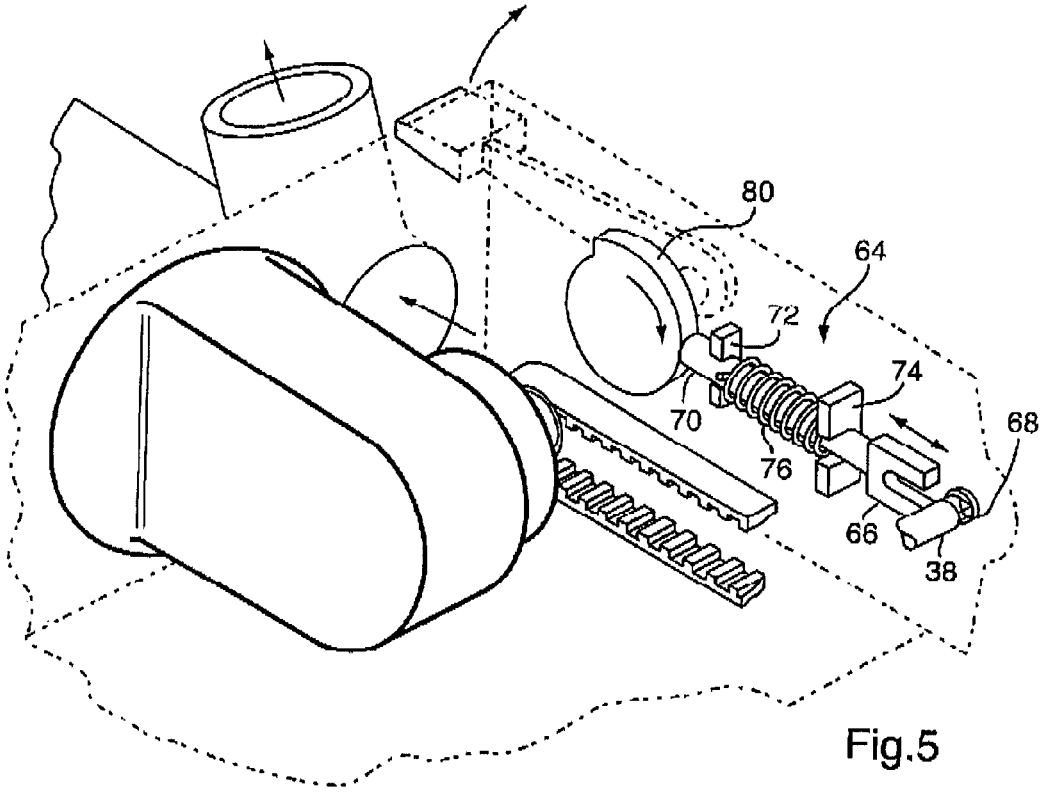
FIG. 5 is a perspective view of a portion of the interior of the tool.
Figure 6:
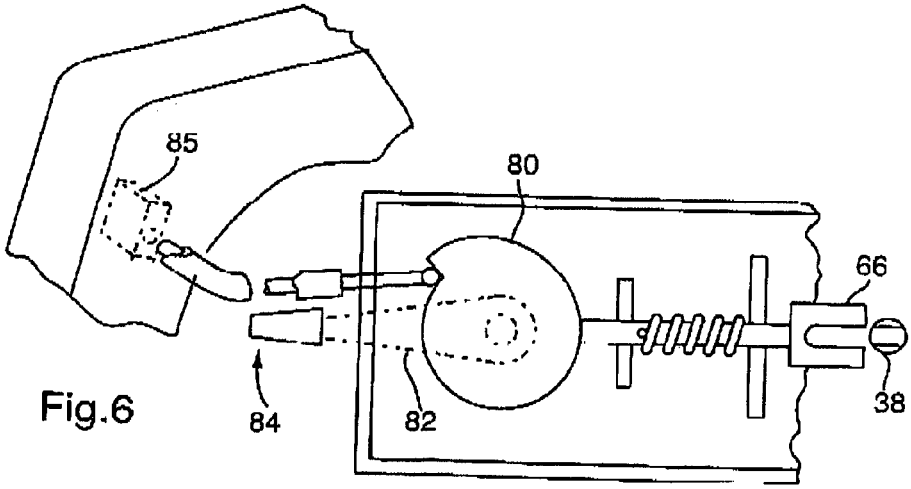
FIG. 6 is an elevation of a portion of the interior of the tool.

With reference to FIGS. 4, 5 and 6, a lock for preventing unintended activation of the drum is indicated generally 64 and includes a bifurcated detent 66 which selectively slides into and out of diametrically opposed grooves 68 in roller shaft 38. The detent is attached to the front end of a plunger 70 which is slidingly supported by spaced brackets 72, 74. A coil spring 76 surrounds the portion of the plunger between the two brackets. The rear end of the plunger is biased by the coil spring against a cam 80.

A catch 82 pivots in the direction of arrow 84 from a lower position illustrated in FIG. 6 to an upper position. In the lower position, the detent is spaced apart from roller shaft 38 and permits the roller shaft to rotate freely. When the catch is raised to the upper position by means of its handle, the cam forces the detent into engagement with the roller shaft and immobilizes it. The cam accordingly pivots from an unlocking position illustrated in FIGS. 5 and 6 to a locking position in which the detent is forced into engagement with the roller shaft.

A conventional electro-micro switch 85 functions to reduce the risk of damage to the tool if an operator unintentionally neglects to unlock catch 82 before operating the tool.

With reference to FIGS. 3, 4 and 8, a depth guide is in the form of a disc 90 having a sleeve 92 on its outer wall for receipt of a cylindrical boss 94 attached to the outer wall of side panel 44. The sleeve has a number of openings 98 each of which receive a spring loaded ball bearing 100 which projects outwardly from the outer wall of the boss. Each opening defines a stop point as the sleeve is rotated about the boss by means of knob 102. The longitudinal axes of sleeve 92 and boss 96 both lie on the continuation or production of the longitudinal axis 38*a*-38*a* of the roller shaft.

A disc 106 of the same structure as disc 90 and having a sleeve which is similarly rotatable about a boss is mounted to left side wall 42 and, like disc 90, is coaxial with bearings 108 in which the roller shaft revolves.

Figure 7:
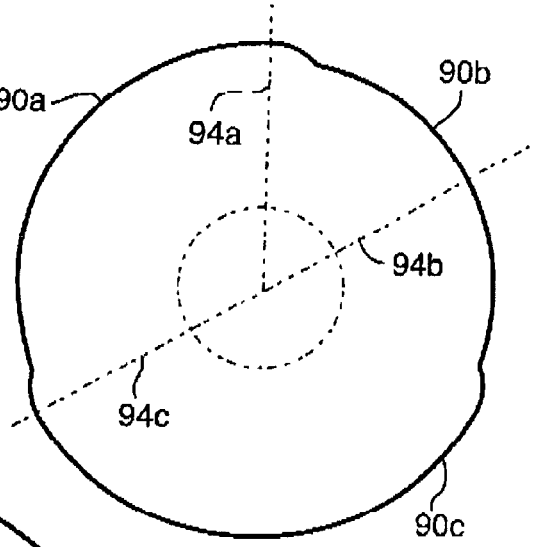
FIG. 7 is an elevation of a depth guide of the tool.
Figure 9:
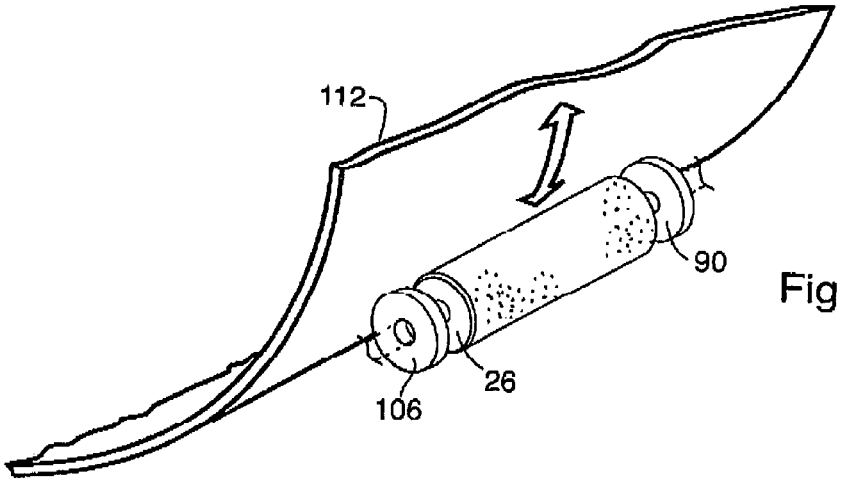
FIG. 9 is a perspective view of a drum of the tool in conjunction with a piece of work.
Figure 10:
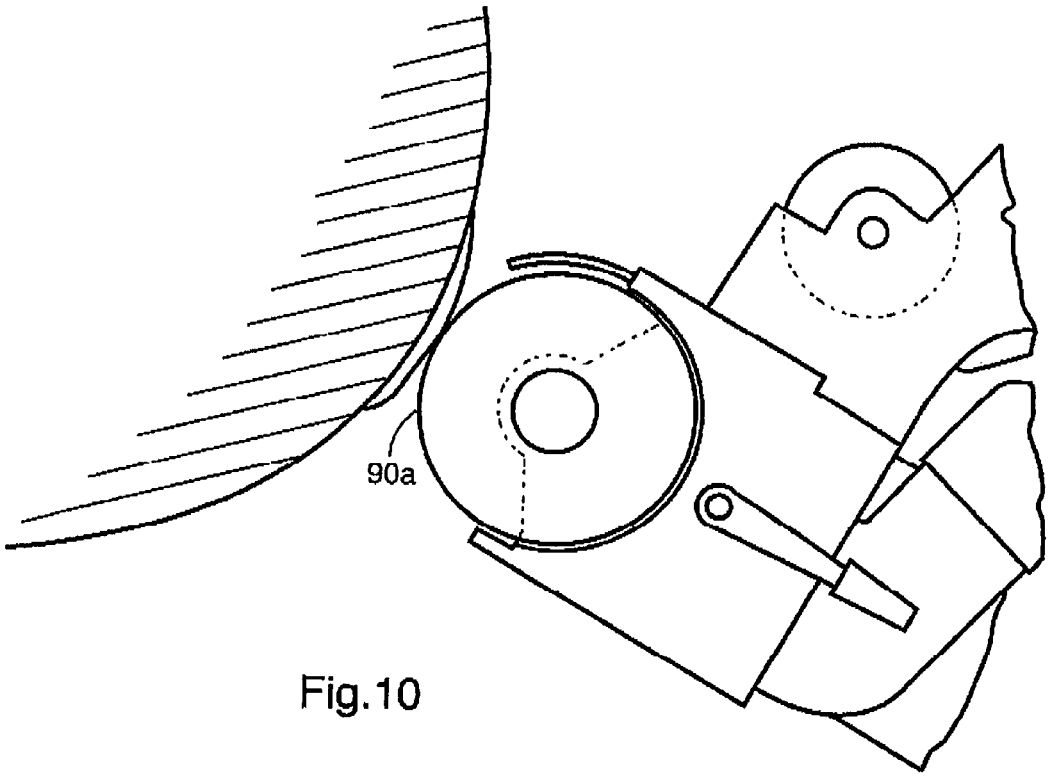
FIG. 10 is an elevation of the drum and piece of work.

With reference to FIGS. 7, 9 and 10, disc 90 has a curved outer edge composed of a number of arcuate segments 90*a, b,c*. Each segment has a radius 94*a,b* and *c* of different defined lengths and each function to determine the depth of penetration of material removed from a work piece by drum 26. In FIGS. 9 and 10, for example, the depth of penetration of the drum into work piece 112 is limited by whichever of the segments of disc 90 and disc 106 are ahead or face forward of the drum. In FIG. 10, segment 90*a* in each disc is the one which determines the depth of penetration.

The curved outer edge of the disc functions as a work piece contracting surface. The surface is spaced apart varying distances from axis 38-38. Pivoting of the disc causes various portions or segments of the contacting surface to face the work piece. The area of the segment or contacting surface which faces the work piece serves to define the depth of material removed from the surface of the work piece.

In the preceding description and in the drawings, the axes of the depth guide or disc and the roller shaft are co-axial and it is preferred that they be so. However the axes need not be co-axial. The depth guide can in fact pivot about an axis offset or spaced apart from the axis of the roller shaft provided appropriate alterations in the shape of the disc are made so that the segments of its outer edge which face the work piece function in the same manner as discs 90 and 106.

Sleeve 92 and ball bearings 100 function to cause the disc to pivot about axis 38*a*-38*a* in increments so that each segment 90*a-c* of the disc in turn face the work piece. As indicated previously, each facing segment of the disc serves to define the depth of material removed from the surface of the work piece.

Figure 11:
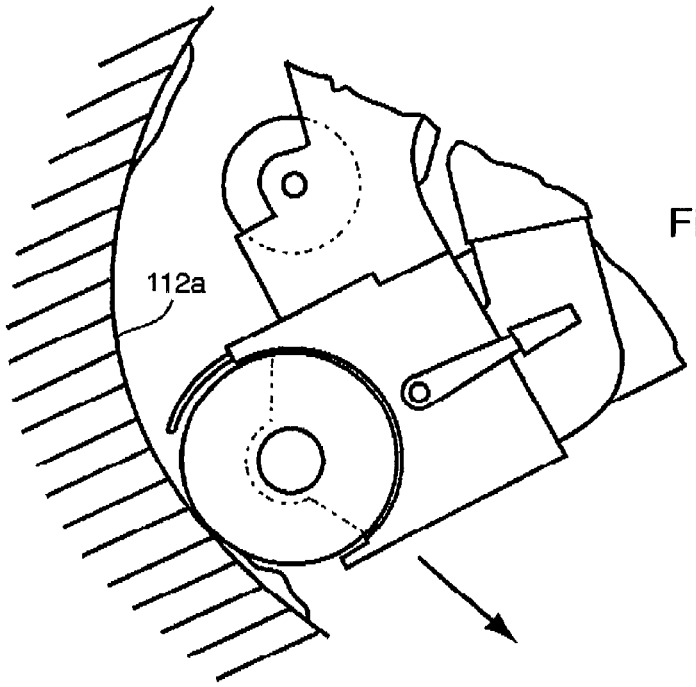
FIGS. 11 and 12 are elevations of the tool and pieces of work of two different shapes Like reference characters refer to like parts throughout the description of the drawings.
Figure 12:
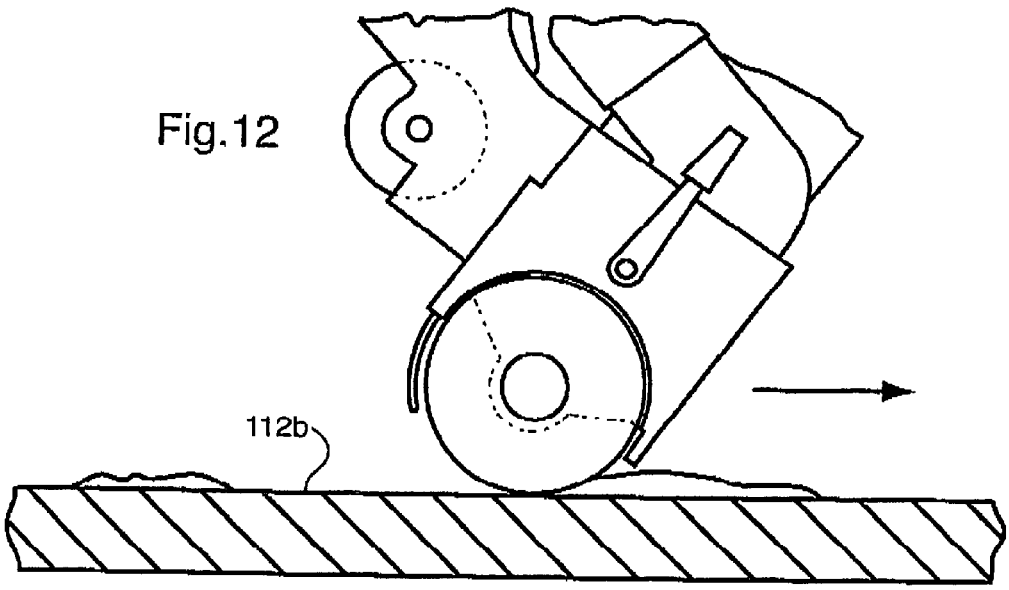

In FIG. 10 the work piece is circular. In FIG. 11, work piece 112*a* is concave while in FIG. 12, work piece 112*b* is flat. In each case, the tool of my invention is capable of removing material from the surface of the work piece to a predetermined depth.

Discs 90, 106 are rotated manually independently of each other and each disc is distinctively marked with the length of the radius of each arc to facilitate the determination of the particular arc that will produce the desired depth of penetration when it faces forward of the drum. Of course, the arc on one disc must be the same as the corresponding arc on the other disc in order to achieve a uniform depth of penetration along the entire length of the drum.

Discs 90 and 106 can be replaced by other discs to provide different depths of penetration. The replacement discs may have three or more arcs each of different radii so that a relatively limited number of discs can provide a wide range of depths of penetration.

It will be understood, of course, that modifications can be made in the sanding and grinding tool of the invention without departing from the scope and purview of the invention as defined in the appended claims.

I claim:

1. A tool for sanding or grinding having means for adjusting the depth of material removed from a surface of a work piece including: a housing; a drum rotatable relative to said housing and having an abrasive cylindrical outer wall; and a depth guide for limiting the depth of penetration of said outer wall into said surface, wherein said depth guide pivots about an axis and has a work piece contacting surface comprised of a plurality of segments spaced various distances apart from said axis, said depth guide being pivotal in increments to cause each said segment in turn, to face said work piece, each said facing segment serving to define the depth of material removed from the surface of said work piece.

2. The tool of claim 1 wherein each said segment is separated by a stop point from adjacent said segments such that at each said stop point, a separate said segment faces said work piece and determines the depth of penetration of said abrasive outer wall into said work piece.

3. The tool as claimed in claim 1 further including a lock for preventing unintended rotation of said drum.

4. The tool as claimed in claim 3 wherein said lock has a detent which selectively prevents said drum from rotating; a cam pivotal from a locking position for causing said detent to prevent said rotation to an unlocking position for causing said detent to release said drum; resilient means for biasing said cam into unlocking position; and a catch for selectively immobilizing said cam in said locking position.

5. The tool of claim 4 wherein said drum is mounted to a roller shaft, said roller shaft having diametrically opposed grooves, said detent being bifurcated for selectively engaging said grooves and when said grooves are so engaged, preventing said roller shaft from rotating, said lock further being provided with a rod having forward and rear ends, said detent being attached to said forward end and said rear end being in contact with said cam, said resilient means being a coil spring disposed concentrically about said rod.

6. The tool of claim 1 wherein said drum has a forward portion which, when said tool is sanding or grinding a work piece, faces said work piece, said tool further including a guard which is disposed above said drum and which has a forward overhanging portion which extends over an upper portion of said forward portion, said guard being arranged and constructed to direct dust and any particles dislodged from said work piece into said housing and away from an operator of said tool.

7. A tool for sanding or grinding having means for adjusting the depth of material removed from a surface of a work piece including: a housing; a drum rotatable relative to said housing and having an abrasive cylindrical outer wall; and a depth guide for limiting the depth of penetration of said outer wall into said surface, wherein said drum rotates about an axis and said depth guide has an axis which lies on the continuation of said axis of said drum, said depth guide further having a curved outer work piece contacting surface comprised of a plurality of arcuate segments each of which having a radius which extends outward from said axis of said depth guide, the radii of said segments being of differing defined lengths.

8. The tool of claim 7 wherein said depth guide is rotatable in increments such that each said segment in turn, is adapted to face said work piece, each said facing segment serving to define the depth of material removed from the surface of said work piece.

9. The tool of claim 8 wherein each said segment is separated by a stop point such that at each said stop point, a separate said segment faces said work piece and determines the depth of penetration of said abrasive outer wall into said work piece.

10. A tool for sanding or grinding having means for adjusting the depth of material removed from a surface of a work piece including: a housing; a drum rotatable relative to said housing and having an abrasive cylindrical outer wall; and a depth guide for limiting the depth of penetration of said outer wall into said surface, said depth guide pivoting about an axis and having a work piece contacting surface comprised of a plurality of segments spaced various distances apart from said axis, said depth guide being pivotal in increments to cause each said segment in turn, to face said work piece, each said facing segment serving to define the depth of material removed from the surface of said work piece.

11. The tool of claim 10 wherein each said segment is separated by a stop point such that at each said stop point, a separate said segment faces said work piece and determines the depth of penetration of said abrasive outer wall into said work piece.

12. A tool for sanding or grinding having means for adjusting the depth of material removed from a surface of a work piece including: a housing; a drum rotatable about an axis and having an abrasive cylindrical outer wall; and a depth guide for limiting the depth of penetration of said outer wall into said surface, said depth guide having an axis which lies on the continuation of said axis of rotation, said depth guide further having a curved outer work piece contacting surface comprised of a plurality of arcuate segments each of which having a radius which extends outward from said axis of said depth guide, the radii of said segments being of differing defined lengths.

13. The tool of claim 12 wherein said depth guide is pivotal in increments to cause each said segment in turn, to face said work piece, each said facing segment serving to define the depth of material removed from the surface of said work piece.

14. The tool of claim 13 wherein each said segment is separated by a stop point from adjacent said segments such that at each said stop point, a separate said segment faces said work piece and determines the depth of penetration of said abrasive outer wall into said work piece.

* * * * *